US011518171B2

(12) United States Patent
Iida

(10) Patent No.: US 11,518,171 B2
(45) Date of Patent: Dec. 6, 2022

(54) LIQUID EJECTION APPARATUS

(71) Applicant: Brother Kogyo Kabushiki Kaisha, Aichi-Ken (JP)

(72) Inventor: Shotaro Iida, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/212,604

(22) Filed: Mar. 25, 2021

(65) Prior Publication Data

US 2021/0300021 A1 Sep. 30, 2021

(30) Foreign Application Priority Data

Mar. 26, 2020 (JP) ..... JP2020-056610

(51) Int. Cl.
*B41J 2/165* (2006.01)
*B41J 2/045* (2006.01)

(52) U.S. Cl.
CPC ..... *B41J 2/16508* (2013.01); *B41J 2/0451* (2013.01); *B41J 2/16579* (2013.01)

(58) Field of Classification Search
CPC ... B41J 2/16508; B41J 2/0451; B41J 2/16579
See application file for complete search history.

(56) References Cited

U.S. PATENT DOCUMENTS 747,547 A 12/1903 Komatsu
8,491,084 B2 7/2013 Sato et al.
2006/0157579 A1 7/2006 Komatsu
2007/0139461 A1 6/2007 Izuo
2011/0063366 A1 3/2011 Sato et al.
2014/0300657 A1 10/2014 Ike
2018/0162120 A1* 6/2018 Matsuoka ..... B41J 2/16526

FOREIGN PATENT DOCUMENTS

JP 2004-050450 A 2/2004
JP 2006-175849 A 7/2006
JP 2007-152889 A 6/2007
JP 2011-062847 A 3/2011
JP 2014-200982 A 10/2014
JP 2016-210020 A 12/2016

* cited by examiner

*Primary Examiner* — Justin Seo
(74) *Attorney, Agent, or Firm* — Banner & Witcoff, Ltd.

(57) ABSTRACT

A liquid ejection apparatus includes a liquid ejection head and a controller. The controller configured to perform: determining whether a discharge failure occurs in a first nozzle; in a case where it is determined that the discharge failure occurs in the first nozzle, determining whether a certain condition is satisfied; in a case where it is determined that the certain condition is satisfied: applying a flushing signal to a second driving element; applying a driving signal to the second driving element; determining whether the discharge failure occurs in a second nozzle; in a case where it is determined that the discharge failure does not occur in the second nozzle, executing a first purge; and in a case where it is determined that the discharge failure occurs in the second nozzle, executing a second purge.

14 Claims, 13 Drawing Sheets

LIQUID EJECTION APPARATUS

CROSS-REFERENCE TO RELATED APPLICATION

This application claims priority from Japanese Patent Application No. 2020-056610 filed on Mar. 26, 2020, the content of which is incorporated herein by reference in its entirety.

TECHNICAL FIELD

The present invention relates to a liquid ejection apparatus that ejects liquid from a nozzle.

BACKGROUND

As an example of the liquid ejection apparatus, a known inkjet printer that performs printing by ejecting ink from each of a plurality of nozzles. The inkjet printer may be configured to identify a nozzle that does not eject ink normally due to various reasons. The inkjet printer may need to remove ink through the identified nozzle to recover normal ejection.

SUMMARY

The removed ink amount for recovering the normal ejection may depend on the various reasons.

One or more aspects of the disclosure provide a liquid ejection apparatus that may determine an ink amount that may be removed through the identified nozzle.

According to one or more aspects of the disclosure, a liquid ejection apparatus includes a liquid ejection head and a controller. The liquid ejection head includes a common channel, a first individual channel, a first driving element, a second individual channel, a second driving element. The first individual channel is connected to the common channel and includes a first nozzle and a first pressure chamber. The first driving element corresponds to the first pressure chamber. The second individual channel is connected to the common channel and includes a second nozzle and a second pressure chamber. The second driving element corresponds to the second pressure chamber. The controller is configured to perform: determining whether a discharge failure occurs in the first nozzle; in a case where it is determined that the discharge failure occurs in the first nozzle, determining whether a certain condition is satisfied; in a case where it is determined that the certain condition is satisfied: applying a flushing signal to the second driving element; applying a driving signal to the second driving element; determining whether the discharge failure occurs in the second nozzle; in a case where it is determined that the discharge failure does not occur in the second nozzle, executing a first purge; and in a case where it is determined that the discharge failure occurs in the second nozzle, executing a second purge.

According to one or more aspects of the disclosure, a liquid ejection apparatus includes a liquid ejection head and a controller. The liquid ejection head includes a common channel, a first individual channel, a first driving element, a second individual channel, a second driving element. The first individual channel is connected to the common channel and includes a first nozzle and a first pressure chamber. The first driving element corresponds to the first pressure chamber. The second individual channel is connected to the common channel and includes a second nozzle and a second pressure chamber. The second driving element corresponds to the second pressure chamber. The controller is configured to perform: determining whether a discharge failure occurs in the first nozzle; in a case where it is determined that the discharge failure occurs in the first nozzle: determining whether a certain condition is satisfied; and determining whether air flows into the first nozzle therefrom, in a case where it is determined that the certain condition is satisfied and where it is determined that the air does not flow into the first nozzle therefrom: applying a flushing signal to the second driving element; applying a driving signal to the second driving element; determining whether the discharge failure occurs in the second nozzle; in a case where it is determined that the discharge failure does not occur in the second nozzle, executing a first purge; and in a case where it is determined that the discharge failure occurs in the second nozzle, executing a second purge.

DETAILED DESCRIPTION

First Embodiment

General Configuration of Printer

Figure 1:
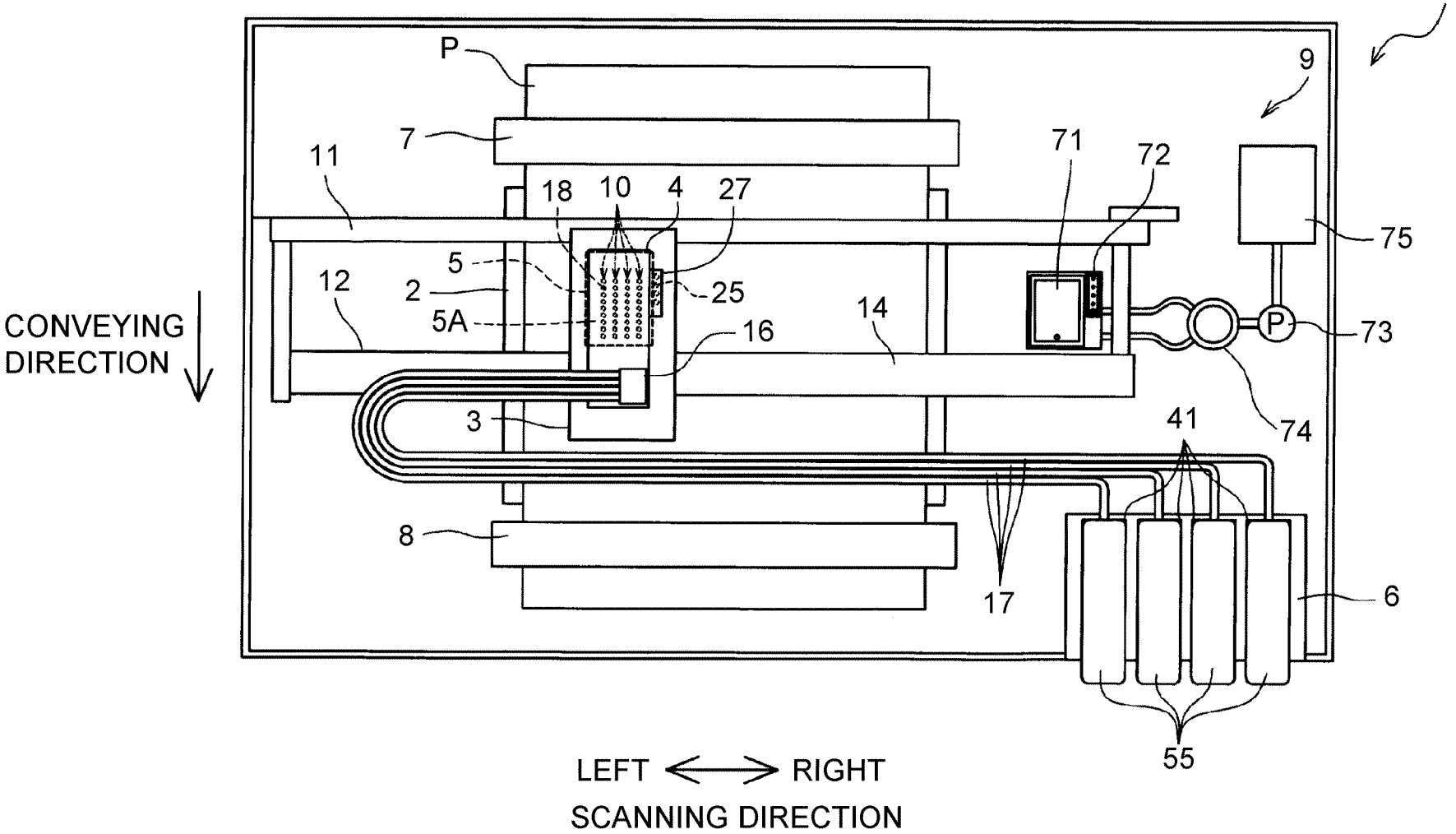
FIG. 1 is a diagram of a general configuration of a printer in an illustrative embodiment according to one or more aspects of the disclosure.

As illustrated in FIG. 1, a printer 1 includes a platen 2, a carriage 3, a subtank 4, an inkjet head 5, a cartridge holder 6, a pair of conveying rollers 7, a pair of conveying rollers 8, a maintenance unit 9. The printer 1 is an example of a "liquid ejection apparatus". The inkjet head 5 is an example of a "liquid ejection head".

The platen 2 includes an upper surface for supporting a sheet P. Two guide rails 11 and 12 are disposed above the platen 2. The two guide rails 11 and 12 extends parallel to a scanning direction. The carriage 3 is configured to move in the scanning direction along the two guide rails 11 and 12. In the following description, a right side and a left side in the scanning direction are defined as shown in FIG. 1.

Figure 2:
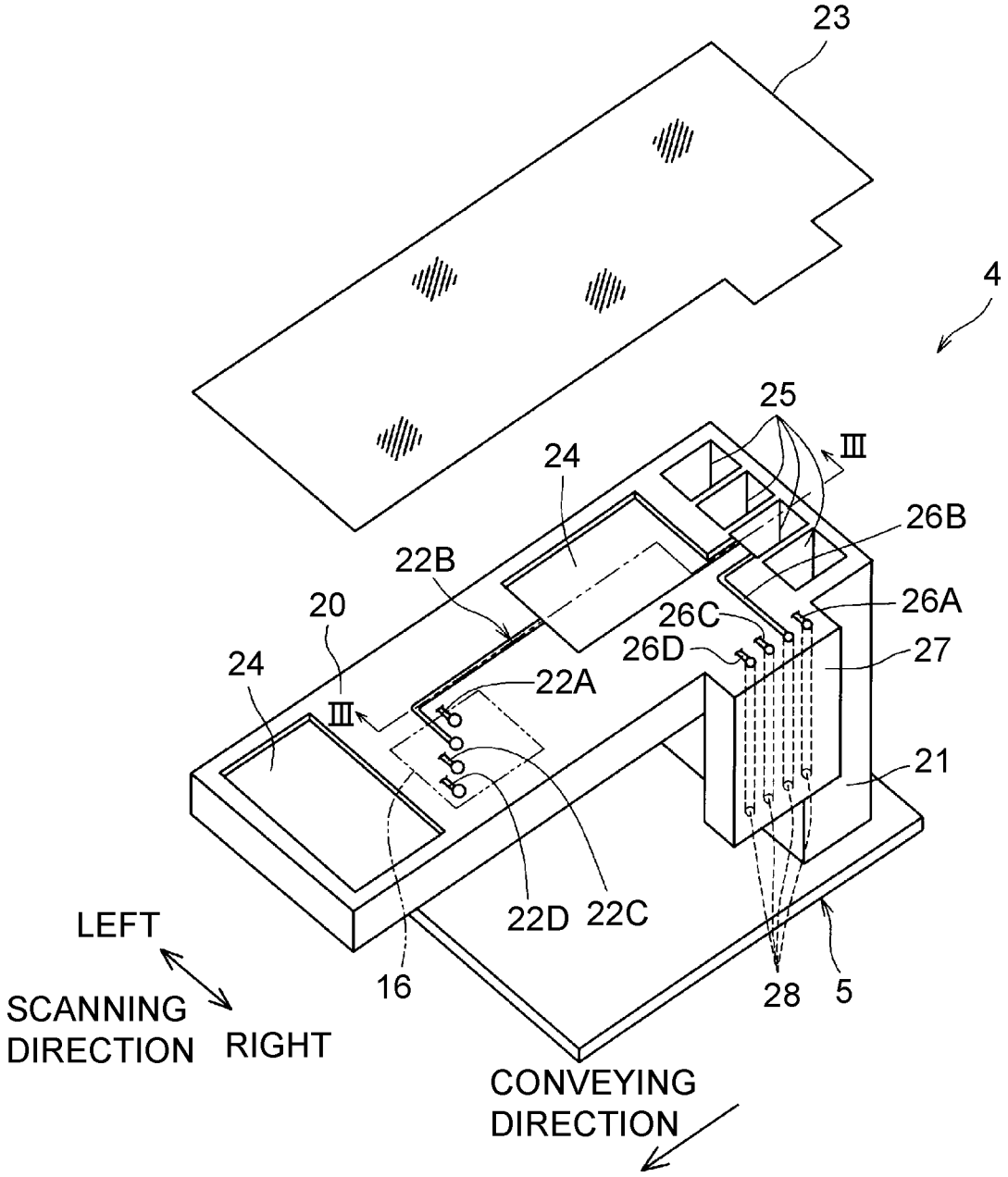
FIG. 2 is a diagram of a general configuration of a subtank in an illustrative embodiment according to one or more aspects of the disclosure.
Figure 3:
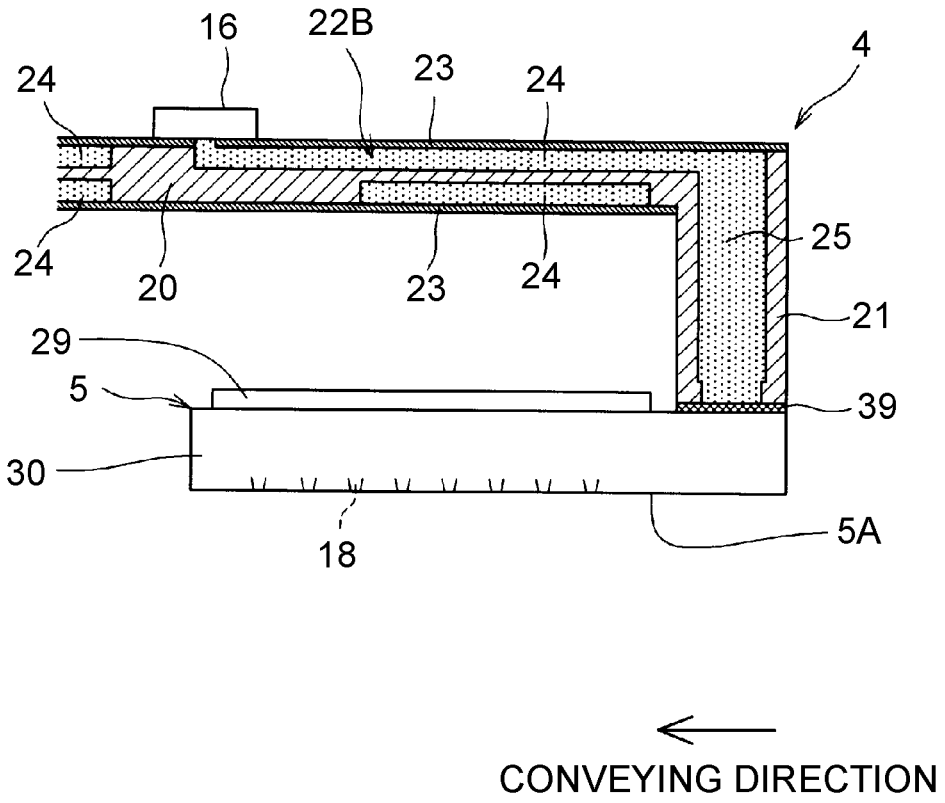
FIG. 3 is a sectional view taken along line of FIG. 2.

The carriage 3 includes the subtank 4. As illustrated in FIGS. 2 and 3, a tube joint 16 is disposed on an upper surface of the subtank 4. The tube joint 16 is configured to communicate with the cartridge holder 6 via four ink tubes 17. The right side of the subtank 4 has an exhaustion unit 27. The exhaustion unit 27 is configured to exhaust air that may be present in the subtank 4 and a channel of the inkjet head 5.

The cartridge holder 6 includes four cartridge attachment members 41 arranged in the scanning direction. Four ink cartridges 55 are attached to cartridge attachment members 41, respectively. The rightmost ink cartridge 55 stores black ink. The ink cartridge 55 disposed next to the ink cartridge 55 of black ink stores yellow ink. The ink cartridge 55 disposed next to the ink cartridge 55 of yellow ink stores cyan ink. The ink cartridge 55 next to the ink cartridge 55 of cyan ink (i.e., the leftmost ink cartridge 55) stores magenta ink. The color ink stored in each four ink cartridges 55 is supplied to the subtank 4 through corresponding ink tube 17.

The inkjet head 5 is disposed below the subtank 4. The inkjet head 5 is configured to receive ink from the subtank 4, and eject ink from a plurality of nozzles 18 of a nozzle surface 5A. The nozzle surface 5A corresponds to a lower surface of the inkjet head 5. The plurality of nozzles 18 are arranged in the conveying direction, and forms a plurality of nozzle rows 10. Four nozzle rows 10 are arranged in the scanning direction on the nozzle surface 5A. The plurality of nozzles 18 in corresponding nozzle row 10 eject each of black, yellow, cyan, and magenta inks.

The pair of conveying rollers 7 and the pair of conveying rollers 8 are configured to convey the sheet P in the conveying direction.

The maintenance unit 9 is disposed at the right side of the platen 2 in the scanning direction. The maintenance unit 9 is configured to maintain or recover ejecting function of the inkjet head 5.

Subtank

Referring to FIGS. 2 and 3, configuration of the subtank 4 will be described. The subtank 4 has a main body portion 20 extending along a horizontal plane, and a connecting portion 21 extending vertically downward from an upstream end of the main body portion 20 in the conveying direction. The subtank 4 includes four ink supply channels 22A, 22B, 22C and 22D. Four nozzle rows 10 are associated with the four ink supply channels 22A, 22B, 22C and 22D, respectively. Each ink flows through corresponding ink supply channel. In FIG. 2, for simplifying the drawing, only the ink supply channel 22B is illustrated entirely, and the remaining three ink supply channels 22A, 22C, and 22D are illustrated partly. In the first embodiment, the combination of the ink tubes 17 and the ink supply channels 22A, 22B, 22C and 22D is an example of a "connection channel".

Each ink supply channels 22A, 22B, 22C and 22D includes a damper chamber 24 and a communication channel 25. The damper chamber 24 is included in the main body portion 20. The communication channel 25 is included in the connecting portion 21. Flexible films 23 are respectively stuck to an upper and lower surfaces of the main body portion 20. A part of channel including the damper chamber 24 is covered with the flexible films 23. A width of an internal part in the damper chamber 24 is greater than a width of each of an upstream part in the damper chamber 24 and a downstream part in the damper chamber 24. A height of an internal part in the damper chamber 24 is less than a height of each of an upstream part in the damper chamber 24 and a downstream part in the damper chamber 24. The damper chamber 24 absorbs pressure fluctuations of ink that flows into the ink supply channels 22A, 22B, 22C and 22D by deformation of the flexible films 23. The connecting portion 21 is configured to communicate with the inkjet head 5. The inkjet head 5 is configured to receive ink that flows through the ink supply channels 22A, 22B, 22C and 22D from the communication channel 25 in the connecting portion 21.

The communication channel 25 extends in the vertical direction, whereby air that may be present in ink is accumulated at the upper portion of the communication channel 25. Accordingly, the air may not flow into the inkjet head 5.

The main body portion 20 includes four exhaustion channels 26A, 26B, 26C and 26D each connects to the communication channel 25 of corresponding ink supply channel 22A, 22B, 22C and 22D. As illustrated in FIG. 2, the exhaustion channels 26A, 26B, 26C and 26D extend to the exhaustion unit 27 that is disposed at the right side of the subtank 4. The exhaustion channels 26A, 26B, 26C and 26D are arranged in the conveying direction in the exhaustion unit 27, and extend in the vertical direction. A lower end of each of the exhaustion channels 26A, 26B, 26C and 26D in the vertical direction has an exhaustion port 28. The exhaustion port 28 is provided in a lower surface of the exhaustion unit 27. The exhaustion unit 27 includes a valve. The valve is configured to allow or cut off air communication with the outside of the exhaustion channels 26A, 26B, 26C and 26D via the exhaustion port 28.

Inkjet Head

Figure 4:
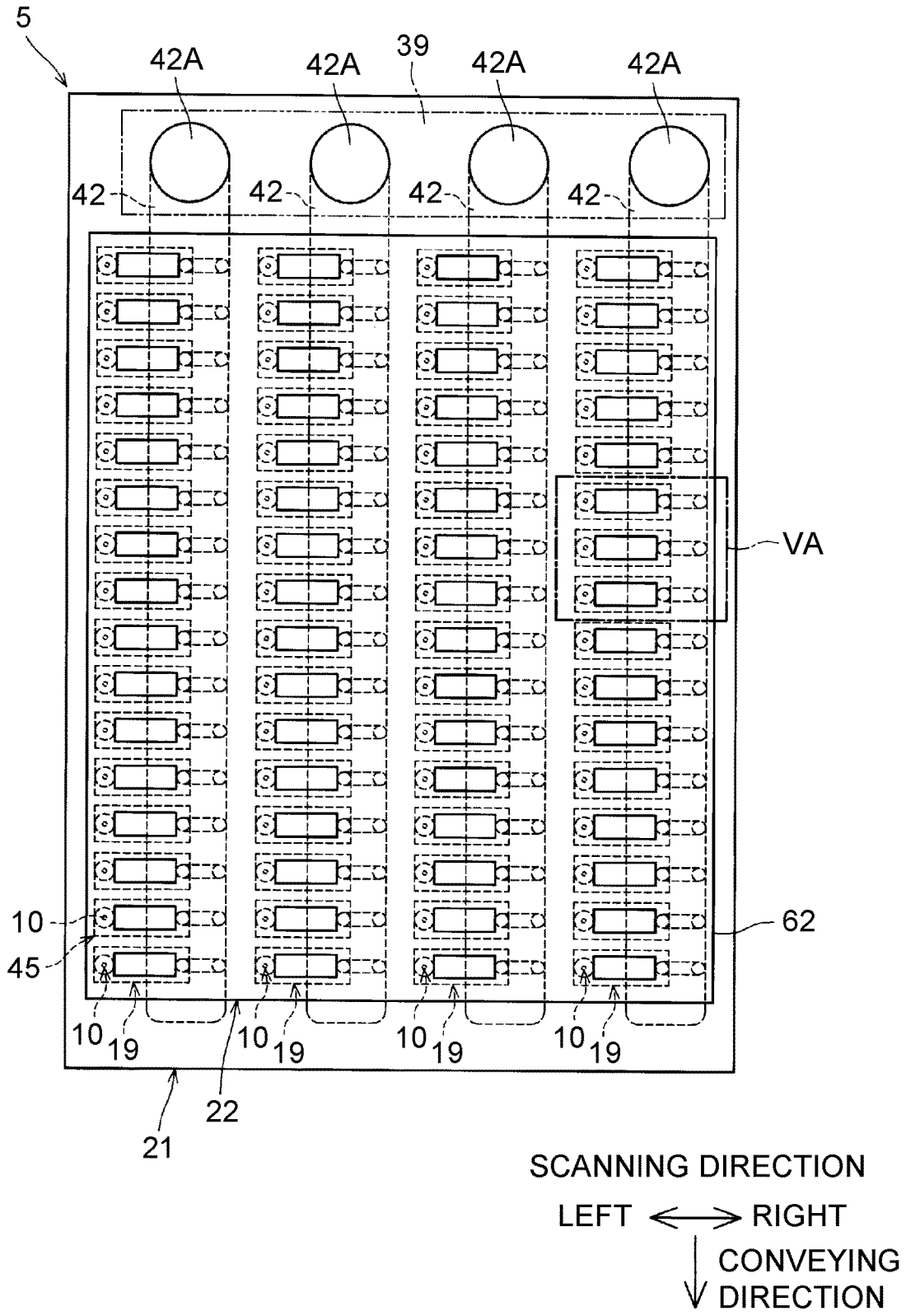
FIG. 4 is a plan view of the inkjet head of FIG. 1 according to the illustrative embodiment of the disclosure.
Figure 5A:
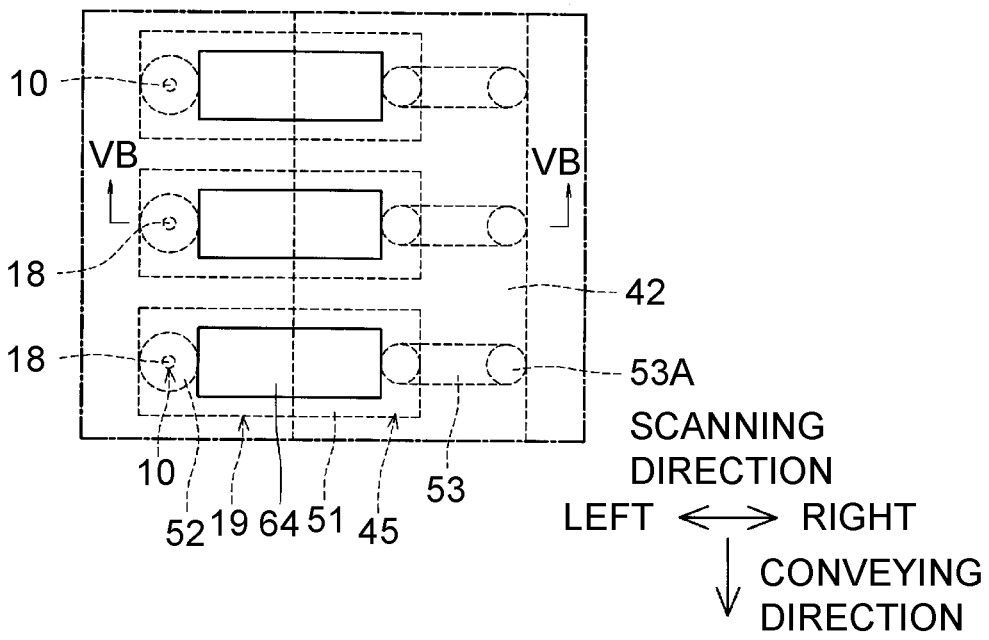
FIG. 5A is an enlarged view of a region VA of FIG. 4.
Figure 5B:
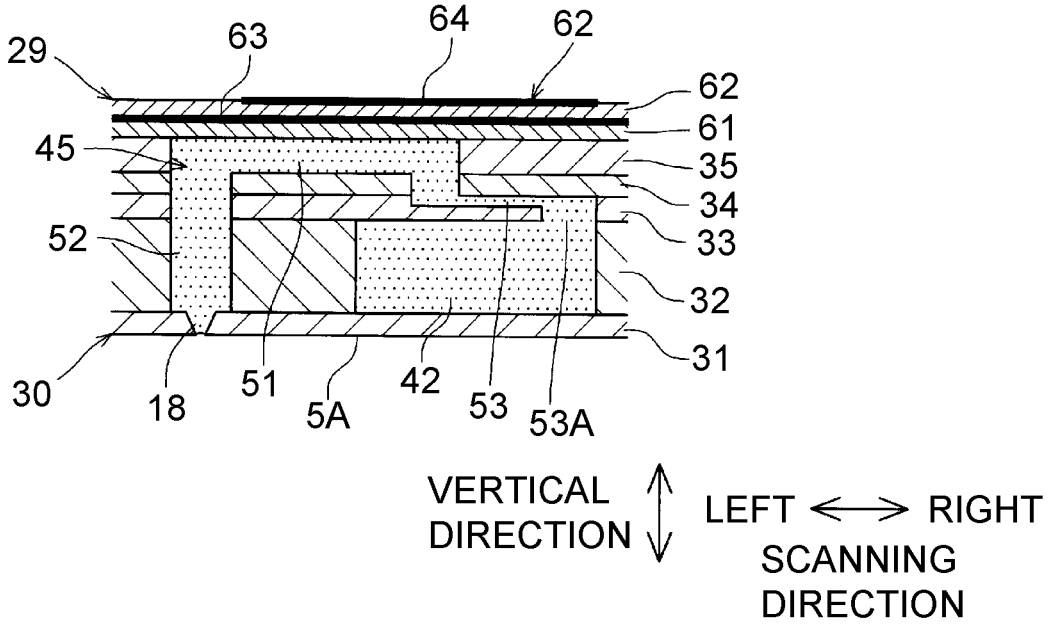
FIG. 5B is a sectional view taken along line VB-VB of FIG. 5A.

As illustrated in FIGS. 4, 5A and 5B, the inkjet head 5 includes a channel unit 30 and a piezoelectric actuator 29.

The channel unit 30 includes plates 31, 32, 33, 34 and 35. The plates 31, 32, 33, 34 and 35 are stacked from a bottom in the order of 31, 32, 33, 34 and 35 in the vertical direction. The plate 31 is made of a synthetic resin. The plates 32 to 35 are conductive, and are made of metal. The stacked plates 31, 32, 33, 34 and 35 are bonded with, for example, a thermosetting adhesive.

The channel unit 30 includes a plurality of individual channels 45 and four common channels 42. Each of the plurality of individual channels 45 includes a nozzle 18. The plurality of individual channels 45 are arranged in the conveying direction to form an individual channel row 19. Corresponding to the plurality of nozzles 18 forming four nozzle rows 10, the channel unit 30 has four individual channel rows 19 arranged in the scanning direction.

Each individual channel 45 includes the nozzle 18, a pressure chamber 51, a descender 52, and a throttle channel 53. The nozzle 18 is connected to a left end portion of the pressure chamber 51 in the scanning direction via the descender 52. The throttle channel 53 is connected to a right end portion of the pressure chamber 51 in the scanning direction. The structures and positional relationships of the nozzle 18, the pressure chamber 51, the descender 52, and the throttle channel 53 are the same as those in the art, and further detailed description thereof will be omitted.

The four common channels 42 correspond to the four individual channel rows 19. Each common channel 42 extends in the conveying direction. As illustrated in FIG. 5A, each common channel 42 overlaps, in the vertical direction, with the right side portions in the scanning direction of the plurality of individual channels 45 in corresponding individual channel row 19. The common channel 42 is connected to each of a plurality of connection ports 53A each located at a right end in the scanning direction of the corresponding throttle channel 53 in the individual channel 45. An upstream end of each common channel 42 in the conveying direction is connected to a supply port 42A of the connecting portion 21. The supply port 42A is an example of a "connecting portion". Through the supply port 42A, ink is supplied from the communication channel 25 to the common channel 42. A filter 39 is disposed between the supply port 42A and the communication channel 25. The filter 39 may capture a foreign matter and air that may be present in the ink.

The piezoelectric actuator 29 includes a vibrating plate 61, a piezoelectric layer 62, a common electrode 63, and a plurality of individual electrodes 64. The vibrating plate 61 is made of a piezoelectric material containing lead zirconate titanate as a main component, which is a mixed crystal of lead titanate and lead zirconate. The vibrating plate 61 is disposed on the upper surface of the channel unit 30 (i.e., the upper surface of the plate 35), and covers the plurality of pressure chambers 51. The piezoelectric layer 62 is made of the piezoelectric material that is the same as the vibrating plate 61. The piezoelectric layer 62 is disposed on the upper surface of the vibrating plate 61, and continuously extends over the plurality of pressure chambers 51. The vibrating plate 61 may be made of, instead of the piezoelectric material, an insulating material, such as a synthetic resin material.

The common electrode 63 is disposed between the vibrating plate 61 and the piezoelectric layer 62, and extends throughout thereof. The common electrode 63 is connected to a power source via a wiring, and is maintained at a ground potential. Each of the plurality of the individual electrodes 64 is disposed above the piezoelectric layer 62. Each of the plurality of individual electrodes 64 is associated with corresponding pressure chamber 51, and covers a center portion of corresponding pressure chamber 51 in the vertical direction. Each of the plurality of the individual electrodes 64 is connected to a driver IC 89 via a wiring. One of the ground potential and the driving potential (e.g., 20V) is selectively applied from the driver IC 89 to each individual electrode 64. According to that the common electrode 63 and the plurality of the individual electrodes 64 are arranged in this manner, a portion of the piezoelectric layer 62 sandwiched between the common electrode 63 and each individual electrode 64 is polarized in a thickness direction.

A portion of the piezoelectric actuator 29 that overlaps each pressure chamber 51 in the vertical direction performs as a driving element 60. In response to that the driver IC 89 in the driving element 60 applies a potential to the individual electrode 64, a potential difference between the individual electrode 64 and the common electrode 63 changes. Such changes of the potential difference may cause deformation of the piezoelectric layer 62 and a portion of the vibrating plate 61 that overlaps the pressure chamber 51 in the vertical direction. The deformation may cause a pressure of ink in the pressure chamber 51 to change, whereby ink is ejected from the nozzle 18 connected to the pressure chamber 51.

Maintenance Unit

As illustrated in FIG. 1, the maintenance unit 9 includes a nozzle cap 71, an exhaustion cap 72, an absorption pump 73, a switching unit 74 and a waste-ink tank 75.

Nozzle Cap and Exhaustion Cap

The nozzle cap 71 is disposed at the right side of the platen 2 in the scanning direction. The nozzle cap 71 is located below the inkjet head 5. Moving the carriage 3 to a maintenance position on the right side of the platen 2 causes the nozzle cap 71 to face the plurality of nozzles 18 of the inkjet head 5.

The exhaustion cap 72 is disposed at the right side of the nozzle cap 71. Moving the carriage 3 to the maintenance position also causes the exhaustion cap 72 to face the four exhaustion ports 28 of the exhaustion unit 27.

The nozzle cap 71 and the exhaustion cap 72 are configured to integrally move up and down. As the nozzle cap 71 and the exhaustion cap 72 integrally move up in a state where the carriage 3 is located at the maintenance position, the nozzle cap 71 contacts the nozzle surface 5A to cover the plurality of nozzles 18 of the inkjet head 5, and the exhaustion cap 72 contacts the exhaustion surface 27A to cover the four exhaustion ports 28. Hereinafter, this state is referred to as a "capping state".

The nozzle cap 71 may not necessarily cover the plurality of nozzles 18 by contacting the nozzle surface 5A. For example, an inkjet head 5 may have a frame so as to surround the nozzle surface 5A. This configuration of the inkjet head 5 enables the nozzle cap 71 to contact the frame of the inkjet head 5 to keep a space between the nozzle surface 5A and the nozzle cap 71 and cover the nozzles 18.

As the nozzle cap 71 and the exhaustion cap 72 move down in a state where the carriage 3 is located at the maintenance position, the nozzle cap 71 separates from the nozzle surface 5A, and the exhaustion cap 72 separates from the exhaustion surface 27A.

In a state where the exhaustion cap 72 is separated from the exhaustion surface 27A, the valve in the exhaustion unit 27 is closed. The closed valve may not allow air communication through the exhaustion channels 26A, 26B, 26C and 26D with the outside thereof via the exhaustion port 28. The exhaustion cap 72 includes a mechanism for opening and closing the valve. In the capping state, this mechanism is configured to open the valve, whereby the exhaustion channels 26A, 26B, 26C and 26D enable to communicate with the outside thereof via the exhaustion port 28.

The absorption pump 73 may be a tube pump. The absorption pump 73 is configured to selectively communicate with either of the nozzle cap 71 or the exhaustion cap 72 in accordance with an operation of the switching unit 74. The absorption pump 73 communicates with the waste-ink tank 75.

Operation of Maintenance Unit

The nozzle may not discharge ink due to various reasons such as "nozzle clogging" or "presence of air in ink". In this embodiment, a condition in which a nozzle does not discharge ink properly may be referred to as a "discharge failure". At the maintenance unit 9, an "absorption purge" may be performed. The absorption purge is a process for discharging, from the plurality of nozzles 18, ink in the inkjet head 5. The absorption purge may be performed in response to driving the absorption pump 73 in the capping state where the nozzle cap 71 is connected to the absorption pump 73 in accordance with an operation of the switching unit 74. The absorption purge may also enable air that may be present in the ink to be discharged.

The nozzle cap 71 may not necessarily cover all the nozzles 18, and the ink in the inkjet head 5 may not necessarily be discharged from all of the nozzles 18 at the absorption purge. For example, the nozzle cap 71 may include a first portion and a second portion. The first portion may cover a plurality of nozzles 18 of the rightmost nozzle row 10 that ejects black ink. The second portion may cover a plurality of nozzles 18 of the remaining three nozzle rows 10 that ejects color inks (i.e., yellow, cyan, and magenta). In this modification, either the black ink or the color inks in the inkjet head 5 can be selectively discharged at the absorption purge. Alternatively, for example, four nozzle caps 71 each may individually cover corresponding nozzle row 10. In this modification, ink may be discharged from the nozzles 18 individually for each nozzle row 10 at the absorption purge.

At the maintenance unit 9, an "exhaustion purge" may be performed. The exhaustion purge is a process for discharging, from the exhaustion port 28 via the exhaustion channels 26A, 26B, 26C and 26D, air in the communication channel 25 or the inkjet head 5. The exhaustion purge may be performed in response to driving the absorption pump 73 in the capping state where the exhaustion cap 72 is connected to the absorption pump 73 in accordance with an operation of the switching unit 74.

Figure 6:
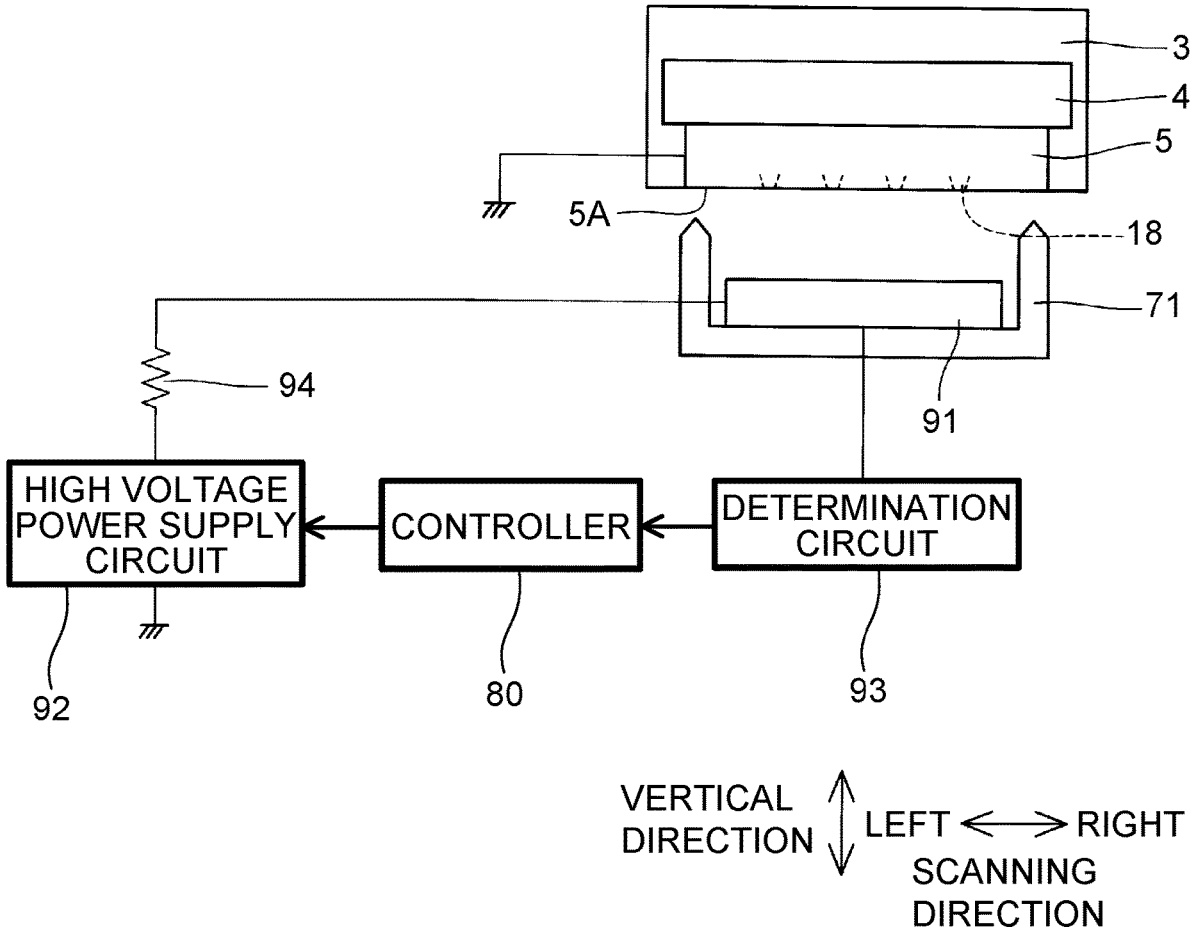
FIG. 6 is a diagram illustrating a detection electrode disposed in a cap, and a connection relationship between the detection electrode and each of a high voltage power supply circuit and a determination circuit.

As illustrated in FIG. 6, a detection electrode 91 having a rectangle shape is disposed in the nozzle cap 71. The detection electrode 91 is configured to communicate with the high voltage power supply circuit 92 via a resistor 94. A certain positive potential (e.g., 300V) is applied to the detection electrode 91 by the high voltage power supply circuit 92. On the other hand, the inkjet head 5 remains to be the ground potential. Accordingly, a certain potential difference is generated between the inkjet head 5 and the detection electrode 91. The detection electrode 91 is electrically connected to a determination circuit 93. The determination circuit 93 is configured to compare the potential using a voltage signal output from the detection electrode 91 with a threshold value VT, and output a signal corresponding to the comparison result.

Figure 7A:
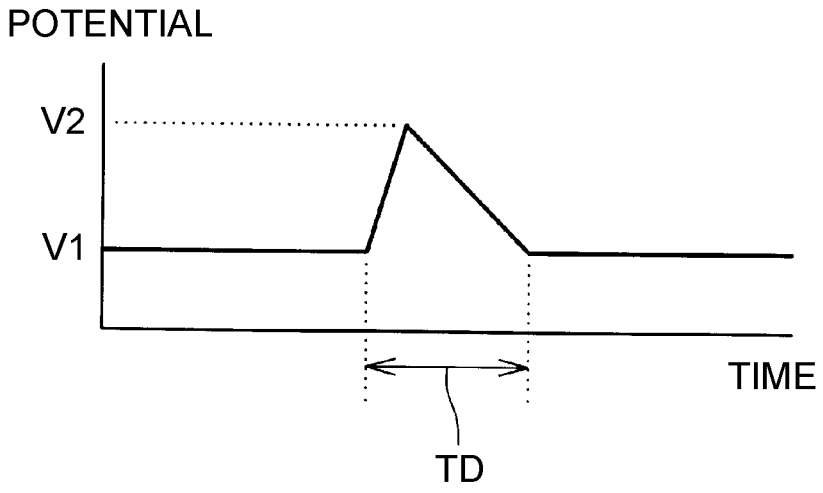
FIG. 7A is a diagram illustrating changes in voltage of the detection electrode in a case where ink is ejected from a nozzle.

A potential difference between the inkjet head 5 and the detection electrode 91 causes ink ejected from the nozzle 18 to be charged. As illustrated in FIG. 7A, the potential of the detection electrode 91 increases from a potential V1 as the ejected ink approaches the detection electrode 91 in a state where the carriage is located at the maintenance position. The increasing potential reaches a potential V2 greater than the potential V1 when the ink reaches the detection electrode 91. The potential gradually decreases, after the ink reaches the detection electrode 91, to the potential V1. Accordingly, the potential of the detection electrode 91 changes during a period TD in which the inkjet head 5 is driven.

Figure 7B:
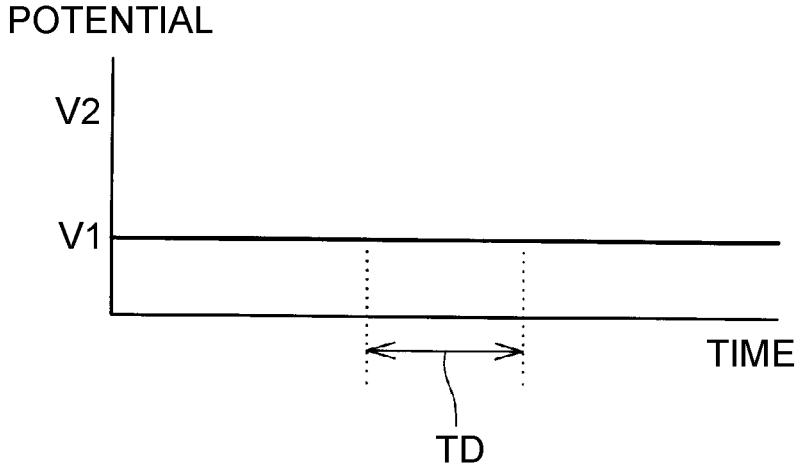
FIG. 7B is a diagram illustrating changes in voltage of the detection electrode in a case where ink is not ejected from a nozzle.

On the other hand, as illustrated in FIG. 7B, the potential of the detection electrode 91 is almost constant at the potential V1 while ink is not ejected from the nozzles 18 during the period TD. Thus, the determination circuit 93 uses the threshold value VT, which is greater than V1 and is less than V2, to distinguish these two conditions. The determination circuit 93 is configured to compare a maximum potential indicated by the voltage signal with the threshold value VT during the period TD, and output the signal corresponding to the comparison result. In this embodiment, the combination of the detection electrode 91, the high voltage power supply circuit 92, the determination circuit 93 and the resistor 94 is an example of a "signal output unit". This signal output unit is configured to output a signal indicating the discharge failure occurs in the nozzle 18.

The high voltage power supply circuit 92 may apply, instead of a positive potential, a negative potential (e.g., −300V) to the detection electrode 91. In this modification, the potential of the detection electrode 91 decreases from a potential V1 as the ejected ink approaches the detection electrode 91 in a state where the carriage 3 is located at the maintenance position. The decreasing potential reaches a certain potential less than the potential V1 when the ink reaches the detection electrode 91. The potential gradually increases from the certain potential after the ink reaches the detection electrode 91 to the potential V1.

Electrical Configuration of Printer.

Figure 8:
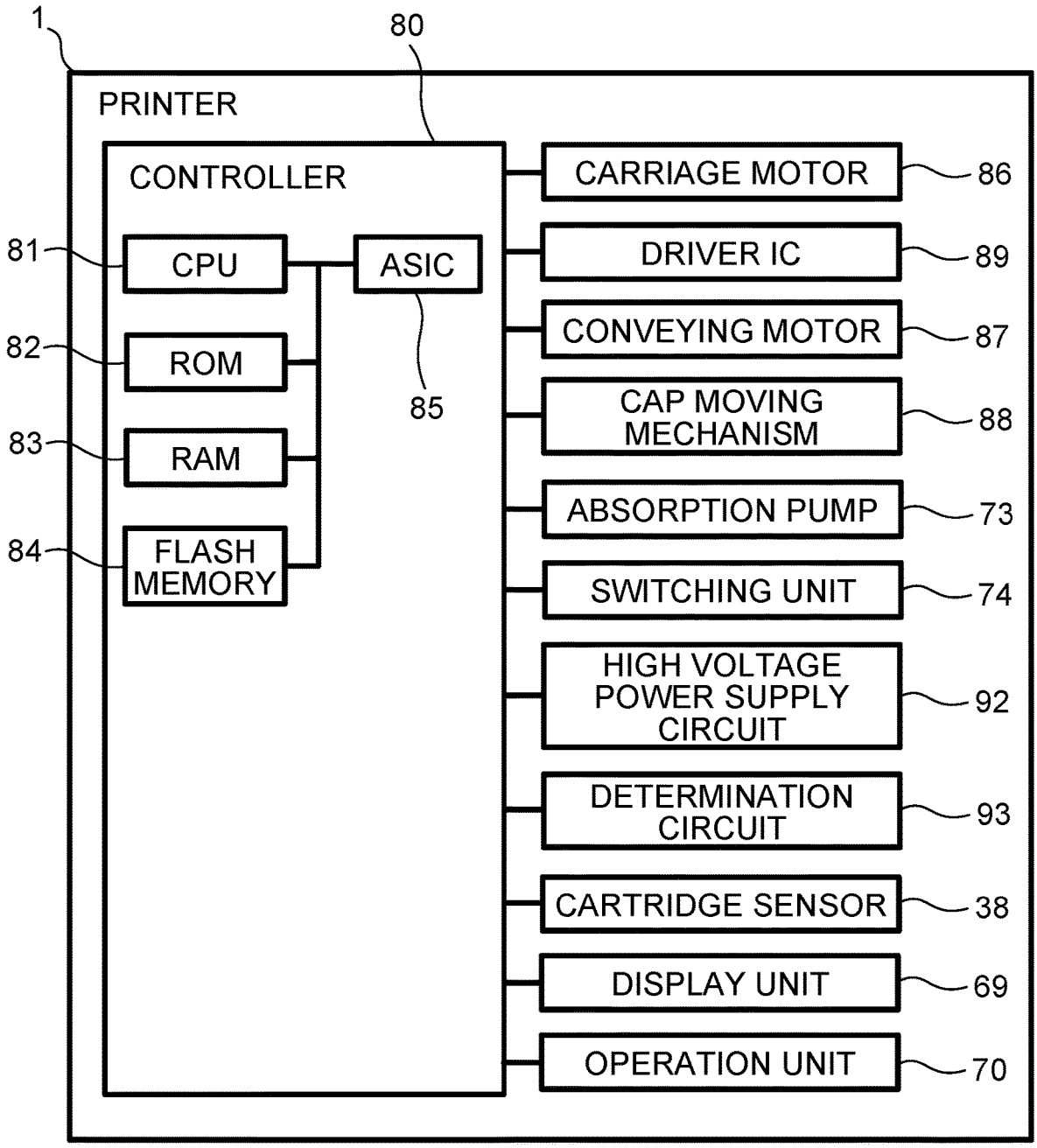
FIG. 8 is a block diagram illustrating an electrical configuration of the printer in an illustrative embodiment according to one or more aspects of the disclosure.

As illustrated in FIG. 8, the printer 1 includes a controller 80 that is configured to control the operation of the printer 1. The controller 80 includes a CPU 81, a ROM 82, a RAM 83, a flash memory 84, and an ASIC 85 that includes various control circuits. The controller 80 is configured to control operations of a carriage motor 86, a driver IC 89, a cap moving mechanism 88, the absorption pump 73 the switching unit 74 and the high voltage power supply circuit 92. The carriage motor 86 is configured to communicate with the carriage 3 via a belt. In response to driving of the carriage motor 86, the carriage 3 moves in the scanning direction. The conveying motor 87 is configured to drive the pair of conveying rollers 7 and the pair of conveying rollers 8. The cap moving mechanism 88 is configured to cause the nozzle cap 71 and the exhaustion cap 72 to integrally move up and down.

The controller 80 is configured to receive from the determination circuit 93 a signal indicating the discharge failure occurs in the nozzle 18. The controller 80 is also configured to receive from the cartridge sensor 38 a signal indicating the ink cartridge 55 is attached to the cartridge attachment member 41.

The printer 1 includes a display unit 69 and an operation unit 70. The display unit 69 may be a liquid crystal display. The controller 80 causes the display unit 69 to display information related to the operation of the printer 1. The operation unit 70 includes buttons. The display unit 69 may be a touchscreen panel that may also be the operation unit 70. The controller 80 is configured to receive a corresponding signal in response to user's operation to the operation unit 70.

Either of the CPU 81 or the ASIC 85 may execute, instead of collaboration of the CPU 81 and the ASIC 85, various processes. One or more CPUs and/or one or more ASICs may share the function to execute various processes.

Control of Ejection Determination

Figure 9:
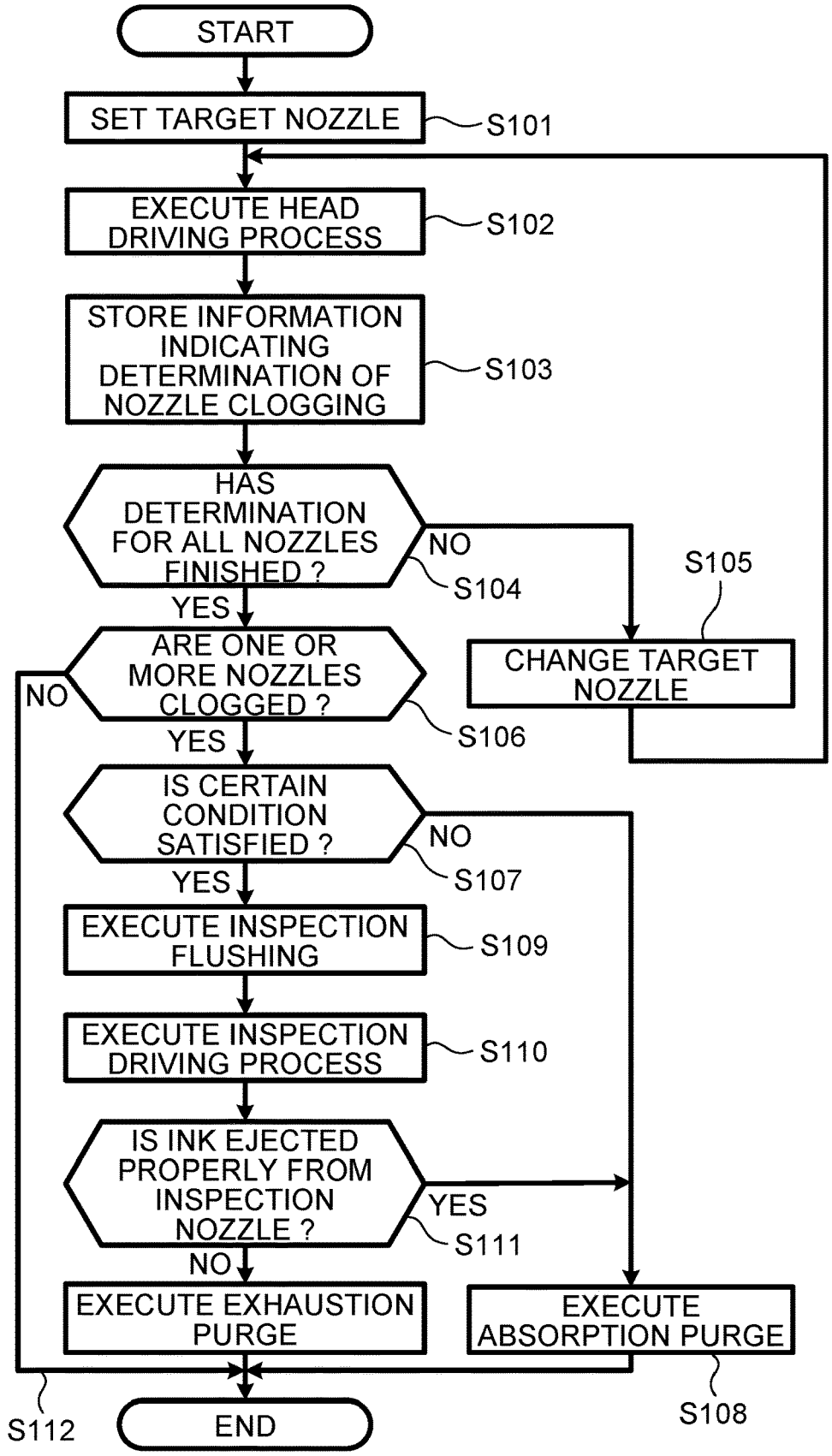
FIG. 9 is a flowchart illustrating processes of determination of a discharge failure and operation in accordance with the determination.

As illustrated in FIG. 9, the controller 80 in this embodiment determines whether the discharge failure occurs in each of the plurality of nozzles 18, and executes either of the absorption purge or the exhaustion purge to recover the ink ejection through the nozzle in which the discharge failure occurs based on the determination result. The processes of FIG. 9 start when the user operates the operation unit 70 to execute maintenance (i.e., the absorption purge or the exhaustion purge). The processes of FIG. 9 may, alternatively, start when a predetermined time has elapsed from the previous maintenance.

In S101, the controller 80 sets one of the plurality of nozzles 18 of the inkjet head 5 as a target nozzle for determining whether the discharge failure occurs in the target nozzle.

In S102, the controller 80 executes a head driving process. In the head driving process of S102, the controller 80 controls the driver IC 89 to drive the driving element 60 corresponding to the target nozzle so as to eject ink from the target nozzle. In S103, the controller 80 determines whether the discharge failure occurs in the target nozzle, and stores information indicating determination result in the flash memory 84. The determination of S103 is based on a signal output from the determination circuit 93 in response to the head driving process of S102.

In S104, the controller 80 determines whether the determination of S103 for all the nozzles 18 has finished. If the controller 80 determines that the determination of S103 for at least one nozzles 18 has not finished (NO in S104), the controller 80 sets another one of the remaining nozzle 18 as the target nozzle in S105, and backs to the process of S102.

If the controller 80 determines that the determination of S103 for all the nozzles 18 has finished (YES in S104), in S106, the controller 80 determines whether the discharge failure occurs in one or more nozzles. The determination of S106 is based on the determination result stored in the flash memory 84. In this embodiment, a nozzle 18 in which the controller 80 determines that the discharge failure occurs is an example of a "first nozzle". An individual channel 45 including the nozzle 18 in which the discharge failure occurs is an example of a "first individual channel".

If the controller 80 determines that the discharge failure does not occur in all the nozzles 18 (NO in S106), the controller 80 terminates the processes of FIG. 9. If the controller 80 determines that the discharge failure occurs in one or more nozzles 18 (YES in S106), in S107, the controller 80 determines whether a certain condition is satisfied.

In this embodiment, one example of the certain condition may be a condition in which an elapsed time from a timing when the ink cartridge 55 is attached to the cartridge attachment member 41 is greater than a predetermined time. This certain condition is based on consideration that a long elapsed time from the attachment of the ink cartridge 55 to the cartridge attachment member 41 may cause an air to be unintentionally introduced in the communication channel 25. The controller 80 stores information of when the ink cartridge 55 is attached. The attachment timing is specified by a signal received from the cartridge sensor 38. Then, the controller 80 calculates the elapsed time based on the attachment timing and a current time, and determines whether the certain condition is satisfied.

If the controller 80 determines that the certain condition is not satisfied (NO in S107), in S108, the controller 80 executes the absorption purge by controlling the carriage motor 86, the cap moving mechanism 88, the absorption pump 73, and the switching unit 74.

If the controller 80 determines that the certain condition is satisfied (YES in S107), in S109, the controller 80 executes an inspection flushing. In the inspection flushing of S109, the controller 80 set a nozzle 18 from a plurality of nozzles 18 in nozzle row 10 as an inspection nozzle. The inspection nozzle is set in each nozzle row 10. The inspection nozzle satisfies a following condition: the discharge failure does not occur in the inspection nozzle; and the inspection nozzle is located at a position where a distance between the supply port 42A and the inspection nozzle is less than a distance between the supply port 42A and each of the other nozzles 18 in the same nozzle row 10 in which the discharge failure does not occur. In this embodiment, the inspection nozzle is an example of a "second nozzle". An individual channel 45 including the inspection nozzle is an example of a "second individual channel".

Thus, the inspection nozzle may be a first upstream nozzle, which is located at the most upstream position in the conveying direction among all the plurality of nozzles 18 in the same nozzle row 10, in a case where the discharge failure does not occur in the first upstream nozzle. Otherwise, the inspection nozzle may be a second upstream nozzle, which is located at the most upstream position in the conveying direction among nozzles 18 in which the discharge failure does not occur in the same nozzle row 10, in a case where the discharge failure occurs in the first upstream nozzle.

In the inspection flushing of S109, the controller 80 controls the driver IC 89 to drive the driving element 60 corresponding to the inspection nozzle by applying a signal so as to eject ink from the inspection nozzle. The driving element 60 corresponding to the inspection nozzle is an example of a "second driving element". The inspection flushing causes to discharge an amount of ink that corresponds to a volume of a certain portion from the filter 39 to the pressure chamber 51 corresponding to the inspection nozzle.

The volume of the certain portion corresponds to a total volume of a first volume and a second volume. The first volume is a volume of a portion of the common channel 42 from the filter 39 to a connection port 53A of the throttle channel 53 corresponding to the inspection nozzle. The second volume is a volume of the throttle channel 53 corresponding to the inspection nozzle. Thus, the inspection flushing may cause air that may be present in the communication channel 25 to flow into and stay in the pressure chamber 51 corresponding to the inspection nozzle. The air does not flow into the pressure chamber 51 corresponding to the inspection nozzle in response to the inspection flushing in a case where the air is not present in the communication channel 25.

After the inspection flushing of S109, in S110, the controller 80 executes an inspection driving process. In the inspection driving process of S110, the controller 80 controls the driver IC 89 to drive the driving element 60 corresponding to the inspection nozzle by applying a signal so as to eject ink from the inspection nozzle. In S111, the controller 80 determines whether the discharge failure occurs in the inspection nozzle. The determination of S111 is based on a signal that is output from the determination circuit 93 in response to the inspection driving process of S110.

If the signal indicates that the ink is properly ejected from the inspection nozzle (YES in S111), i.e., if the signal indicates that the discharge failure does no occur in the inspection nozzle, in S108, the controller 80 executes the absorption purge. The determination circuit 93 outputs a signal indicating that the discharge failure does not occur in the inspection nozzle in a case where the air is not present in the pressure chamber 51 corresponding to the inspection nozzle after the inspection flushing of S109.

On the other hand, if the signal indicates that the ink is not properly ejected from the inspection nozzle (NO in S111), i.e., if the signal indicates that the discharge failure occurs in the inspection nozzle, in S112, the controller 80 executes an exhaustion purge by controlling the carriage motor 86, the cap moving mechanism 88, the absorption pump 73, and the switching unit 74. The determination circuit 93 outputs a signal indicating that the discharge failure occurs in the inspection nozzle in a case where the air is present in the pressure chamber 51 corresponding to the inspection nozzle after the inspection flushing process of S109.

Effect

Even if the controller 80 determines that the certain condition is satisfied in S107, air may not be present in the communication channel 25. That is, under the certain condition, the discharge failure may occur in the nozzle 18 due to the air flowing from the communication channel 25 into corresponding individual channel, or due to another reason.

Thus, in this embodiment, when the controller 80 determines that the certain condition is satisfied, the controller 80 executes the inspection flushing. In the inspection flushing, the controller 80 causes the inspection nozzle, which is different from the nozzle in which the discharge failure occurs, to eject ink. The ejected ink enables the air to flow into the pressure chamber 51 corresponding to the inspection nozzle, and stored therein.

The air stored in the pressure chamber 51 causes the discharge failure in the inspection nozzle in response to the inspection flushing of S109. On the other hand, the discharge failure does not occur in the inspection nozzle in response to the inspection flushing of S109 in a case where the air is not stored in the pressure chamber 51.

That is, the inspection flushing of S109 enables to specify whether the reason of the discharge failure is due to the air present in the communication channel 25, or due to another reason (e.g., air unintentionally introduced from outside via corresponding nozzle 18). According to the specification of the reason, the controller 80 executes either of the absorption purge or the exhaustion purge. This configuration enables to appropriately discharge ink and/or air that may be in the inkjet head 5.

In this embodiment, the first upstream nozzle, which is located at the most upstream position in the conveying direction among all the plurality of nozzles 18 in the same nozzle row 10, is set as the inspection nozzle in a case where the discharge failure does not occur in the first upstream nozzle. This configuration may enable to reduce the amount of discharged ink in the inspection flushing.

In this embodiment, the controller 80 executes the absorption purge in a case where it is determined that the discharge failure does not occur in the inspection nozzle. According to the absorption purge, ink may be discharged from the nozzle 18, whereby the ink ejection through the nozzle 18 may be recovered.

On the other hand, the controller 80 executes the exhaustion purge in a case where it is determined that the discharge failure occurs in the inspection nozzle. According to the exhaustion purge, air in the communication channel 25 is discharged with ink, whereby the ink ejection through the nozzle 18 may also be recovered.

In response to the ink cartridge 55 being attached to the cartridge attachment member 41, air may flow into the cartridge attachment member 41, and be introduced with ink in the communication channel 25. Thus, as the elapsed time from the timing when the ink cartridge 55 is attached to the cartridge attachment member 41 increases long, the amount of air stored in the communication channel 25 increases. This enables air to flow easily into the channel of the inkjet head 5 from the communication channel 25, resulting in poor print quality. Thus, in this embodiment, the controller 80 determines whether the certain condition related to the elapsed time is satisfied. Accordingly, the controller 80 enables to estimate appropriately whether the air may be stored in the communication channel 25.

In this embodiment, the controller 80 causes the driving element 60 to drive so as to eject ink toward the detection electrode 91 from the nozzle 18. Then, the controller 80 receives the signal from the determination circuit 93 indicating potential change at the detection electrode 91. Accordingly, the controller 80 enables to determine whether the discharge failure occurs in the nozzle.

In the first embodiment, the filter 39 is disposed between the supply port 42A of the common channel 42 and the communication channel 25. This configuration enables the filter 39 to capture air in the ink, and store the captured air in the communication channel 25.

Due to existence of the filter 39, the inspection flushing causes the captured air in the communication channel 25 to flow into corresponding pressure chamber 51, and store therein.

Second Embodiment

Figure 10:
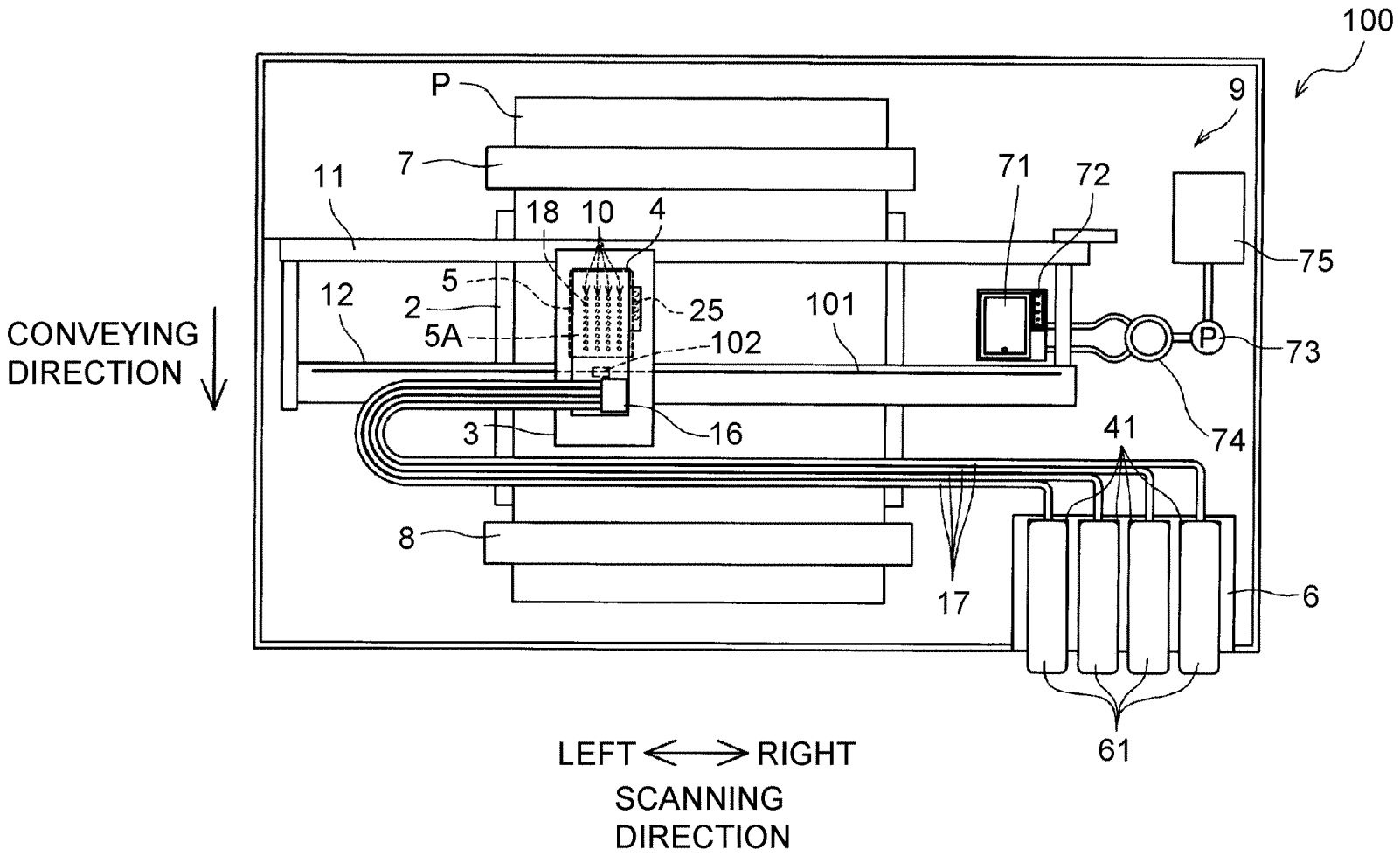
FIG. 10 is a diagram of a general configuration of a printer in an illustrative embodiment according to one or more aspects of the disclosure.

As illustrated in FIG. 10, a printer 100 according to the second embodiment further includes, in addition to the same configurations of the printer 1, an encoder strip 101 and an encoder sensor 102.

The encoder strip 101 is disposed above the guide rails 12, and extends in the scanning direction. The encoder strip 101 includes a plurality of slits arranged with equally spaced interval in the scanning direction. The encoder sensor 102 is disposed at the carriage 3. The encoder sensor 102 is configured to detect the slits of the encoder strip 101, and is configured to send a signal indicating the detection result to the controller 80.

In the second embodiment, the controller 80 obtains information indicating a position of the carriage 3 in the scanning direction based on the number of detected slits by the encoder sensor 102. The controller 80 also obtains information indicating a moving speed of the carriage 3 based on the time interval at which each slit is detected by the encoder sensor 102. Further detail of how to obtain information indicating the position of the carriage 3 in the scanning direction and the moving speed of the carriage 3 using the encoder sensor 102 may be referred to certain prior arts disclosing the configurations of the encoder strip 101.

In the second embodiment, the control device 80 may selectively execute a weak absorption purge and a strong absorption purge. An amount of discharged ink in the strong absorption purge is greater than that in the weak absorption purge. For example, the absorption pump 73 may be driven for a longer period in the strong absorption purge than in the weak absorption purge. Alternatively, the rotation speed of the absorption pump 73 in the strong absorption purge may be greater than that in the weak absorption purge. Accordingly, the amount of discharged ink in the strong absorption purge is greater than that in the weak absorption purge.

Figure 11:
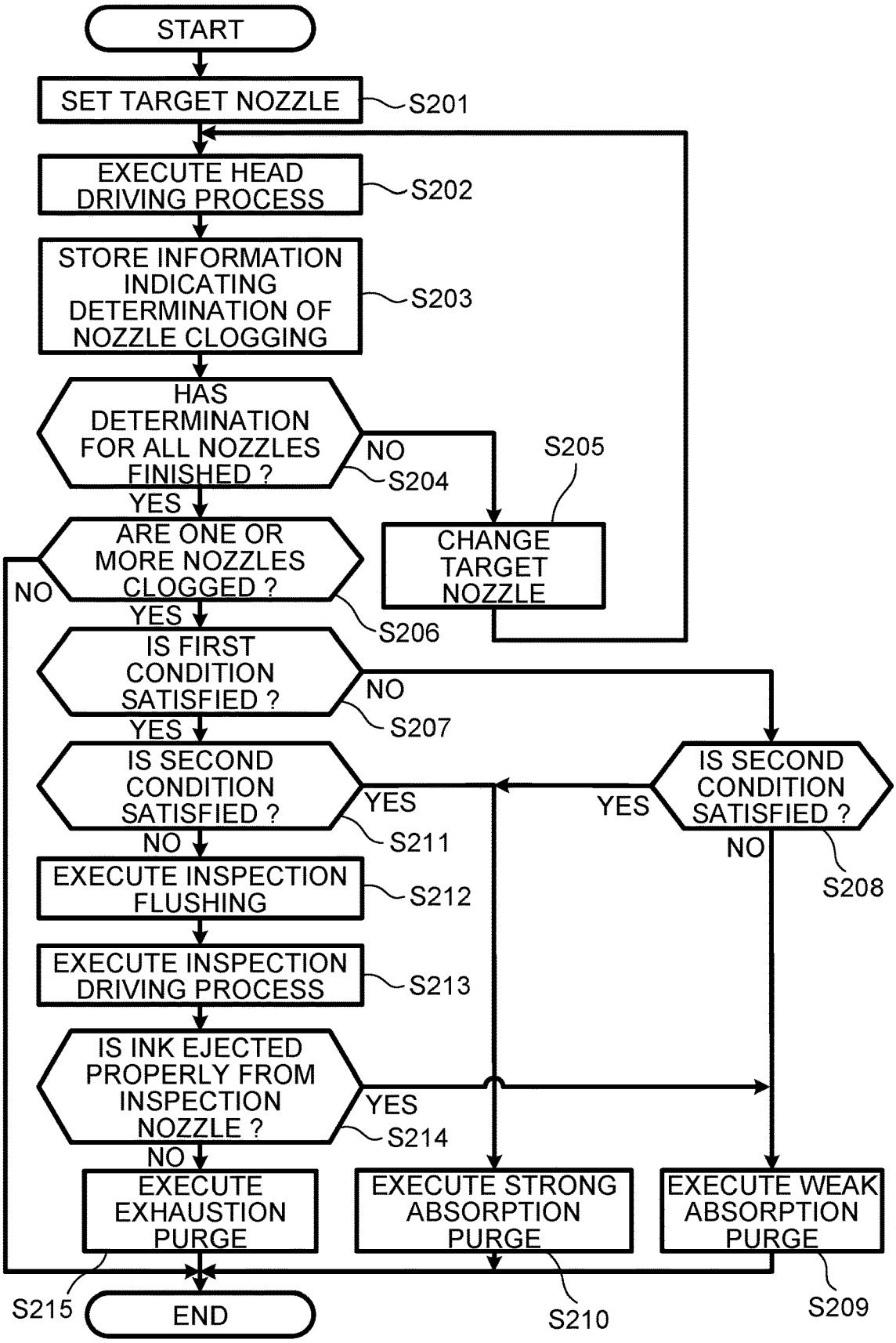
FIG. 11 is a flowchart illustrating processes of determination of a discharge failure and operation in accordance with the determination.

In the second embodiment, as illustrated in FIG. 11, the controller 80 determines whether the discharge failure occurs in each of the plurality of nozzles 18, and executes either of the strong absorption purge, the weak absorption purge, or the exhaustion purge to recover the ink ejection through the nozzle in which the discharge failure occurs based on the determination result.

As illustrated in FIG. 11, the controller 80 executes the processes of S201, S202, S203, S204, S205 and S206 that are the same as the processes of S101, S102, S103, S104, S105 and S106 in FIG. 9. If the controller 80 determines that the discharge failure occurs in one or more nozzles 18 (YES in S206), in S207 the controller 80 determines whether a first condition is satisfied. One example of the first condition may be a condition in which an elapsed time from a timing when the ink cartridge 55 is attached to the cartridge attachment member 41 is greater than a predetermined time, which is the same as the example of the certain condition in the first embodiment.

If the controller 80 determines that the first condition is not satisfied (NO in S207), in S208 the controller 80 determines whether a second condition is satisfied.

One example of the second condition may be a condition in which the carriage 3 stops due to a paper jam during the immediately preceding recording process. In this example of the second condition, the controller 80 determines whether the carriage 3 has stopped during the immediately preceding recording process by using a signal from the encoder sensor 102 during the immediately preceding recording process.

Another example of the second condition may be a condition in which ink is not supplied sufficiently to the inkjet head 5 (i.e., under-refilling phenomenon). The under-refilling phenomenon may cause the discharge failure in a plurality of nozzles 18, especially nozzles 18 located relatively far from the supply port 42A. In this example of the second condition, the controller 80 determines whether the under-refilling phenomenon has occurred during the immediately preceding recording process by using the determination result of S203. The controller 80 may use the determination result for one or more nozzles 18 located relatively far from the supply port 42A.

If the controller 80 determines that the second condition is not satisfied (NO in S208), in S209 the controller 80 executes the weak absorption purge. In the weak absorption purge, the controller 80 controls the carriage motor 86, the cap moving mechanism 88, the absorption pump 73, and the switching unit 74.

If the controller 80 determines that the second condition is satisfied (YES in S208), in S210 the controller 80 executes the strong absorption purge. In the strong absorption purge, the controller 80 controls the carriage motor 86, the cap moving mechanism 88, the absorption pump 73, and the switching unit 74.

If the controller 80 determines that the first condition is satisfied (YES in S207), in S211 the controller 80 determines whether the second condition is satisfied. If the controller 80 determines that the second condition is satisfied (YES in S211), in S210 the controller 80 executes the strong absorption purge.

If the controller 80 determines that the second condition is not satisfied (NO in S211), the controller 80 executes the processes of S212, S213 and S214 that are the same as the processes of S109, S110 and S111 in FIG. 9. If the controller 80 determines that the ink is properly ejected from the inspection nozzle (YES in S214), in S209 the controller 80 executes the weak absorption purge. On the other hand, if the controller 80 determines that the ink is not properly ejected from the inspection nozzle (NO in S214), in S215 the controller 80 executes the exhaustion purge.

Effect

The discharge failure in the nozzle 18 may occur due to various reasons including a first reason, a second reason, and another reason. The first reason may be a reason by which air is unintentionally introduced from the communication channel 25 into corresponding individual channel, which corresponds to the first condition. The second reason may be a reason by which air is unintentionally introduced via the nozzle 18 from outside thereof, which corresponds to the second condition. If the first condition is satisfied and the second condition is not satisfied, the discharge failure in the nozzle 18 may occur due to either of the first reason or the other reason.

Thus, in this embodiment, if the controller 80 determines that the first condition is satisfied and the second condition is not satisfied, the controller 80 executes the inspection flushing. In the inspection flushing, the controller 80 causes the inspection nozzle, which is different from the nozzle in which the discharge failure occurs, to eject ink. The ejected ink enables the air to flow into and stay in the pressure chamber 51 corresponding to the inspection nozzle.

In a case where the air is stored in the communication channel 25, the inspection flushing causes the air in the communication channel 25 flows into and stays in the pressure chamber 51. Accordingly, the discharge failure may occur in the inspection nozzle. Thus, in the second embodiment, the controller 80 executes either of the weak absorption purge or the exhaustion purge after the inspection driving process of S213. This configuration enables to appropriately discharge ink and/or air that may be in the inkjet head 5.

If the controller 80 determines that the second condition is satisfied, the discharge failure may occur in the nozzle 18 due to the air unintentionally introduced via the nozzle 18 from outside thereof. Thus, in the second embodiment, the controller 80 executes the strong absorption purge if the controller 80 determines that the second condition is satisfied. This configuration enables to appropriately discharge ink and/or air that may be in the inkjet head 5.

Modification

The above embodiments are merely examples. Various modifications may be applied therein without departing from the spirit and scope of the disclosure.

Figure 12:
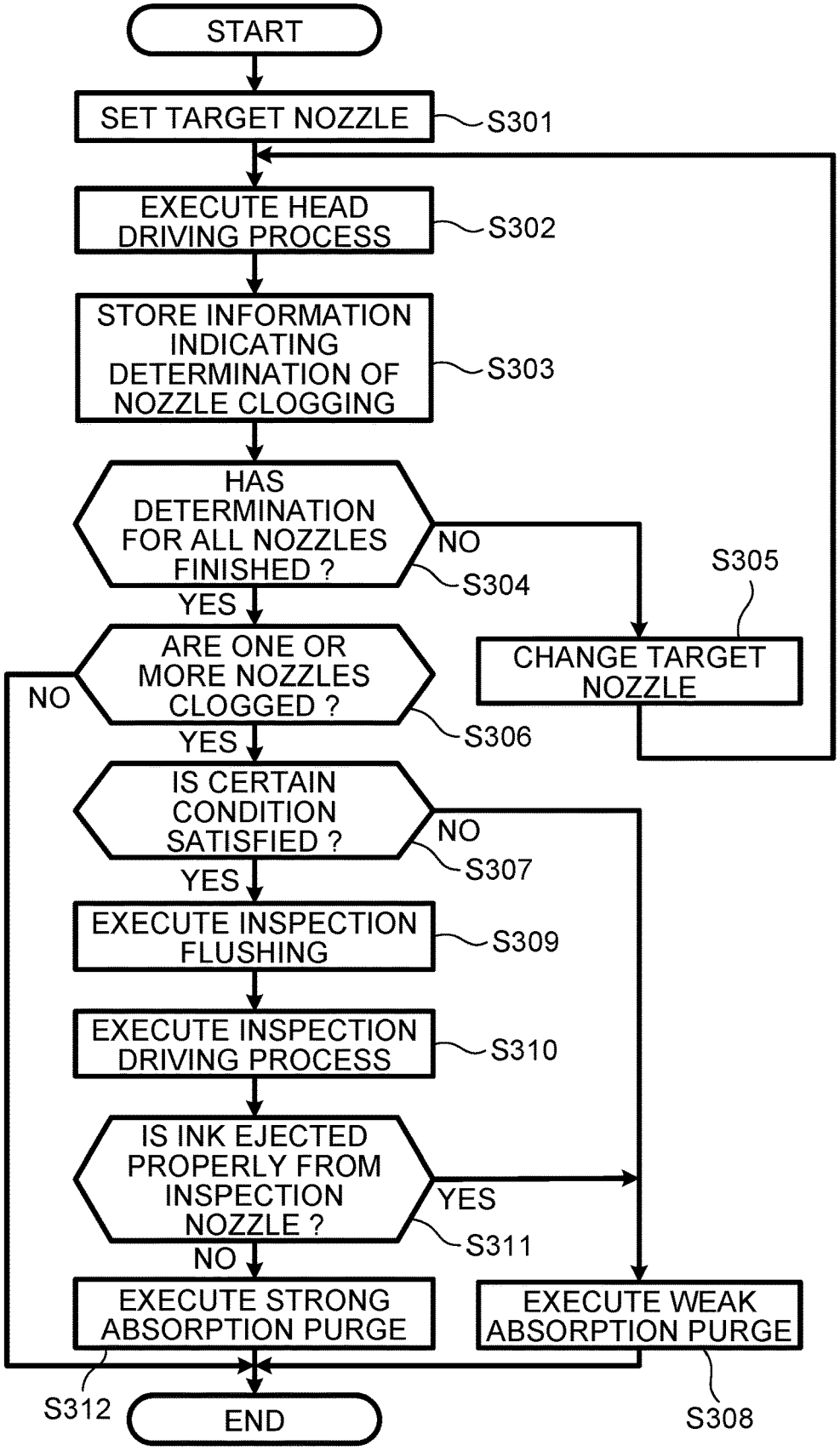
FIG. 12 is a flowchart illustrating processes of determination of a discharge failure and operation in accordance with the determination in modification.

In a first modification, as illustrated in FIG. 12, the controller 80 executes, in accordance with determination whether the discharge failure occurs in the inspection nozzle, either of the strong absorption purge or the weak absorption purge, instead of execution of either of the absorption purge or the exhaustion purge in the first embodiment. The weak absorption purge is an example of a "first purge", and the strong absorption purge is an example of a "second purge".

As illustrated in FIG. 12, the controller 80 executes the processes of S301, S302, S303, S304, S305, S306, S307, S309, S310 and S311, which are the same as the processes of S101, S102, S103, S104, S105, S106, S107, S109, S110 and S111 in FIG. 9. If the controller 80 determines that the certain condition is not satisfied (NO in S307), in S308 the controller 80 executes the weak absorption purge. If the controller 80 determines that the ink is properly ejected from the inspection nozzle (YES in S311), in S308 the controller 80 executes the weak absorption purge. On the other hand, if the controller 80 determines that the ink is not properly ejected from the inspection nozzle (NO in S311), in S312 the controller 80 executes the strong absorption purge.

In the first modification, the controller 80 executes the strong absorption purge in a case where it is determined that the ink is not properly ejected from the inspection nozzle. According to the strong absorption purge, air in the communication channel 45 is discharged with ink, whereby the ink ejection through the nozzle 18 may be recovered.

On the other hand, the controller 80 executes the weak absorption purge in a case where it is determined that the ink is properly ejected from the inspection nozzle. According to the weak absorption purge, the ink ejection through the nozzle 18 may be recovered with less amount of discharged ink.

Figure 13:
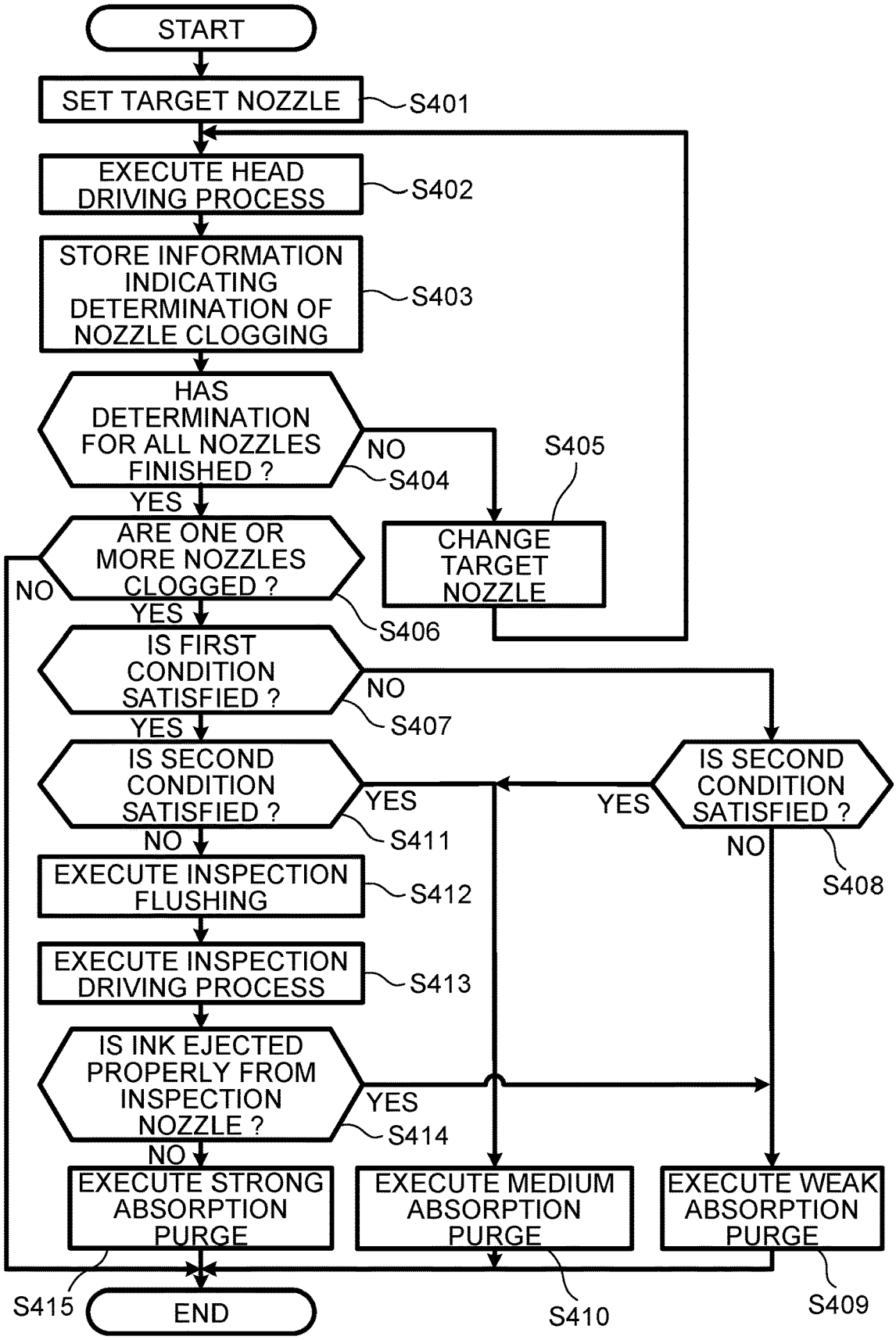
FIG. 13 is a flowchart illustrating processes of determination of a discharge failure and operation in accordance with the determination in modification.

In a second modification, as illustrated in FIG. 13, the controller 80 executes, in accordance with determination whether each of the first and second conditions is satisfied, either of the strong absorption purge, a medium absorption purge, or the weak absorption purge, instead of either of the exhaustion purge, the strong absorption purge or the weak absorption purge in the second embodiment. An amount of discharged ink in the medium absorption purge is greater than that in the weak absorption purge, and is less than that in the strong absorption purge.

As illustrated in FIG. 13, the controller 80 executes the processes of S401, S402, S403, S404, S405, S406, S407, S408, S411, S412, S413 and S414, which are the same as the processes of S201, S202, S203, S204, S205, S206, S207, S208, S211, S212, S213 and S214 in FIG. 11.

If the controller 80 determines that the first condition is not satisfied (NO in S407) and that the second condition is not satisfied (NO in S408), in S409 the controller 80 executes the weak absorption purge. If the controller 80 determines that the first condition is not satisfied (NO in S407) and that the second condition is satisfied (YES in S408), in S410 the controller 80 executes the medium absorption purge. If the controller 80 determines that the first condition is satisfied (YES in S407) and that the second condition is also satisfied (YES in S411), in S410 the controller 80 executes the medium absorption purge.

If the controller 80 determines that the first condition is satisfied (YES in S407) and that the second condition is not satisfied (NO in S411), the controller determines whether the discharge failure occurs in the inspection nozzle (S414) after the inspection flushing of S412 and the inspection driving process of S413. If the controller 80 determines that the ink is properly ejected from the inspection nozzle (YES in S414), in S409 the controller 80 executes the weak absorption purge. On the other hand, if the controller 80 determines that the ink is not properly ejected from the inspection nozzle (NO in S414), in S415 the controller 80 executes the strong absorption purge.

The amount of discharged ink in the inspection flushing may be changeable as long as the controller 80 may cause the captured air in the communication channel 25 to flow into and stay in corresponding pressure chamber 51. A filter 39 disposed between the supply port 42A and the communication channel 25 may be eliminated.

The certain condition of the first embodiment and the first condition of the second embodiment may be a condition where a user instructs to execute a maintenance operation via the operation unit 70, instead of the condition in which the elapsed time from the timing when the ink cartridge 55 is attached to the cartridge attachment member 41 is greater than a predetermined time.

The certain condition of the first embodiment, the first condition of the second embodiment, and the second condition of the second embodiment may include a plurality of conditions. In this modification, the controller 80 may determine that each condition is satisfied in a case where any one of the plurality of conditions is satisfied.

The inspection nozzle may be any one of nozzles 18 in the same nozzle row 10 that is located at upstream position in the conveying direction than the nozzle in which the discharge failure occurs.

The inspection nozzle may also be any one of nozzles 18 in the same nozzle row 10 that is located at downstream position in the conveying direction than the nozzle in which the discharge failure occurs.

The controller 80 may determine whether the discharge failure occurs in the nozzle 18 using another type of detection electrode that extends in the vertical direction. In this modification, the controller 80 may receive from the determination circuit 93 a signal indicating the discharge failure does not occur in the nozzle 18 in response to that ejected ink passes in front of the detection electrode. The ejected ink may be detected by using an optical sensor, instead of the detection electrode 91.

The inkjet head 5 may include a voltage detection circuit as an example of the "signal output unit" that detects a change in voltage in response to ejection of ink.

A substrate of the inkjet head 5 may include a temperature detection element as an example of the "signal output unit". In this modification, a first voltage is applied to drive a heater that may cause to eject ink. After the first voltage is applied, a second voltage is applied to drive the heater that may not cause to eject ink. The controller 80 may determine whether the discharge failure occurs in the nozzle 18 in accordance with a change in temperature at the temperature detection element during a period from the application of the second voltage to an elapse of a predetermined time.

The controller 8 may determine whether the discharge failure occurs in the nozzle 18 using an image of a test pattern, instead of using the signal output by the signal output unit. In this modification, the controller 80 causes the inkjet head 5 to eject ink for generating the image of the test pattern. The user may check the result of the test pattern, and input the result in the printer 1 via the operating unit 70. A scanning unit may scan the test pattern, and generate a signal indicating the scanned result.

Instead of the absorption pump 73, the printer 1 may include a pressurizing pump that may be disposed at a middle of the tube 17, or connected to the ink cartridge 55. In this modification, the controller 80 may cause the pressurizing pump to discharge air and/or ink. The pressurizing pump may be an example of the "discharging unit".

The controller 80 may include both of the pressurizing pump and the absorption pump 73 to discharge air and/or ink. The combination of the pressurizing pump and the absorption pump 73 may be an example of the "discharging unit".

The present invention may also be applied to a liquid ejection head other than the inkjet head.

What is claimed is:

1. A liquid ejection apparatus comprising:

a liquid ejection head comprising:

a common channel;

a first individual channel connected to the common channel, the first individual channel including a first nozzle and a first pressure chamber;

a first driving element corresponding to the first pressure chamber;

a second individual channel connected to the common channel, the second individual channel including a second nozzle and a second pressure chamber; and a second driving element corresponding to the second pressure chamber, and a controller configured to perform:

determining whether a discharge failure occurs in the first nozzle;

in a case where it is determined that the discharge failure occurs in the first nozzle, determining whether a certain condition is satisfied;

in a case where it is determined that the certain condition is satisfied:

applying a flushing signal to the second driving element; and applying a driving signal to the second driving element;

determining whether the discharge failure occurs in the second nozzle;

in a case where it is determined that the discharge failure does not occur in the second nozzle, executing a first purge; and in a case where it is determined that the discharge failure occurs in the second nozzle, executing a second purge.

2. The liquid ejection apparatus according to claim 1, further comprises:

a subtank including a communication channel connected to the common channel, and an exhaustion port communicated with the communication channel;

a first cap configured to cover the first nozzle and the second nozzle;

a second cap configured to cover the exhaustion port;

a pump; and a switching unit configured to cause the pump to be selectively communicated with the first cap or the second cap, wherein the first purge is executed when the pump is communicated with the first cap, and wherein the second purge is executed when the pump is communicated with the second cap.

3. The liquid ejection apparatus according to claim 1, wherein the liquid ejection head includes a connection portion that connects to the common channel, and wherein the second individual channel is disposed closer to the connection portion than the first individual channel is to the connection portion.

4. The liquid ejection apparatus according to claim 3, wherein the second individual channel is disposed closer to the connection portion than any other individual channel is to the connection portion.

5. The liquid ejection apparatus according to claim 1, wherein the first purge is a first liquid purge that discharges liquid from one or more nozzles in a corresponding individual channel, wherein the second purge is a second liquid purge that discharges liquid from one or more nozzles included in a corresponding individual channel, and wherein the second liquid purge enables discharging liquid more than the first liquid purge.

6. The liquid ejection apparatus according to claim 1, wherein the liquid ejection apparatus further includes:

a communication channel connected to the common channel; and an exhaustion channel that branches from the communication channel, wherein the first purge is a liquid purge that discharges liquid from one or more nozzles in a corresponding individual channel, and wherein the second purge is an exhaustion purge that discharges air from one or more nozzles in a corresponding individual channel.

7. The liquid ejection apparatus according to claim 1, wherein the liquid ejection apparatus further comprises:

a cartridge attachment member configured to be attached a liquid cartridge; and a connection channel that connects to each of the attached cartridge and the liquid ejection head, wherein the controller is configured to determine that the certain condition is satisfied in a case where an elapsed time from a timing when the cartridge is attached to the cartridge attachment member is greater than a predetermined time.

8. The liquid ejection apparatus according to claim 1, wherein the liquid ejection apparatus further comprises a signal output member that outputs a signal in accordance with a determination of whether liquid is ejected from a nozzle, and wherein the controller is configured to determine whether the discharge failure occurs in each of the first nozzle and the second nozzle based on the signal outputted from the signal output member.

9. The liquid ejection apparatus according to claim 1, wherein the liquid ejection apparatus further comprises:

a communication channel connected to the common channel; and a filter disposed between the common channel and the communication channel.

10. The liquid ejection apparatus according to claim 9, wherein the controller is configured to apply the flushing signal to the second driving element such that a volume of liquid defined by the filter and the pressure chamber in the second individual channel is discharged from the second nozzle.

11. A liquid ejection apparatus comprising:

a liquid ejection head comprising:

a common channel;

a first individual channel connected to the common channel, the first individual channel including a first nozzle and a first pressure chamber;

a first driving element corresponding to the first pressure chamber;

a second individual channel connected to the common channel, the second individual channel including a second nozzle and a second pressure chamber;

a second driving element corresponding to the second pressure chamber, and a controller configured to perform:

determining whether a discharge failure occurs in the first nozzle;

in a case where it is determined that the discharge failure occurs in the first nozzle:

determining whether a certain condition is satisfied; and determining whether air flows into the first nozzle from outside of the first nozzle, in a case where it is determined that the certain condition is satisfied and where it is determined that the air does not flow into the first nozzle from outside of the first nozzle:

applying a flushing signal to the second driving element;

applying a driving signal to the second driving element;

determining whether the discharge failure occurs in the second nozzle;

in a case where it is determined that the discharge failure does not occur in the second nozzle, executing a first purge; and in a case where it is determined that the discharge failure occurs in the second nozzle, executing a second purge.

12. The liquid ejection apparatus according to claim 11, wherein in a case where it is determined that the air storing member does not store air therein and that the air does not flow into the first nozzle from outside of the first nozzle, the controller is configured to execute a first liquid purge for one or more nozzles.

13. The liquid ejection apparatus according to claim 11, wherein in a case where it is determined that the air flows into the first nozzle from outside of the first nozzle, the controller is configured to execute a second liquid purge for one or more nozzles.

14. The liquid ejection apparatus according to claim 13, wherein the second liquid purge enables discharging more liquid than the first liquid purge.

* * * * *